United States Patent [19]

Uchikoshi

[11] Patent Number: 4,634,030

[45] Date of Patent: Jan. 6, 1987

[54] LAUNDRY PRESSER FOR SIMULTANEOUSLY PRESSING MULTIPLE CLOTHING SECTIONS

[75] Inventor: Mituyuki Uchikoshi, Hachiouji, Japan

[73] Assignee: Sankousha Co., Ltd., Hachiouji, Japan

[21] Appl. No.: 752,363

[22] Filed: Jul. 5, 1985

[30] Foreign Application Priority Data

Jul. 17, 1984 [JP] Japan ..... 59-147969

[51] Int. Cl.[4] ..... D06F 71/18

[52] U.S. Cl. ..... 223/57; 223/70; 38/23

[58] Field of Search ..... 223/68, 70, 57, 71, 223/52; 38/22, 23

[56] References Cited

U.S. PATENT DOCUMENTS 3,583,610 6/1971 Forse ..... 223/70 X
3,715,064 2/1973 North et al. ..... 223/70 X
3,749,292 7/1973 Engelbart ..... 223/57
4,423,561 1/1984 Cortabbia ..... 223/70 X

FOREIGN PATENT DOCUMENTS 2138490 3/1973 Fed. Rep. of Germany ..... 223/70

OTHER PUBLICATIONS

Schwarz, O. B. et al., *Pictorial Handbook of Technical Devices*, Chemical Publishing Company, 1971, pp. 376–379, 258–259.

Graf, R. F., *Radio Shack Unabridged Dictionary of Electronics*, Howard W. Sams & Company, 1974–1975, pp. 489, 565.

*Primary Examiner*—Werner H. Schroeder
*Assistant Examiner*—Andrew M. Falik
*Attorney, Agent, or Firm*—Sachs & Sachs

[57] ABSTRACT

A laundry presser includes body, shoulder and tack presser units which are driven for substantially concurrent pressing of several sections of an article of clothing such as a shirt, for saving of time, labor and a reduction in necessary equipment space.

7 Claims, 2 Drawing Figures

LAUNDRY PRESSER FOR SIMULTANEOUSLY PRESSING MULTIPLE CLOTHING SECTIONS

BACKGROUND OF THE INVENTION

The present invention relates to a laundry presser, and more particularly relates to an improvement in function of a laundry presser adapted for professional applications.

For conventional laundering at laundries, different pressers are used for pressing of different sections of articles of clothing such as a shoulder section, a body section and a tack section. A presser for one section is unsuited for another section. So, several pressers have to be used for total pressing of an article of clothing such as a shirt. Use of several pressers requires a large space for installation. Transfer of an article of clothing between pressers is quite time-consuming, thereby seriously lowering operation efficiency of laundering. Loss in operation time may be somewhat reduced by concurrent operation of all pressers involved in total pressing. However, this manner of operation cannot reduce labor problems since different pressers have to be controlled by different operators.

SUMMARY OF THE INVENTION

It is the object of the present invention to enable efficient total pressing of an article of clothing with reduced labor and a reduction in the space necessary for machine installation.

In accordance with the basic aspect of the present invention, a laundry presser is provided with concurrently operable clothing bearer, a skirt holder unit, a body presser unit, a shoulder presser unit and tack presser units.

DESCRIPTION OF THE PREFERRED EMBODIMENTS

Figure 1:
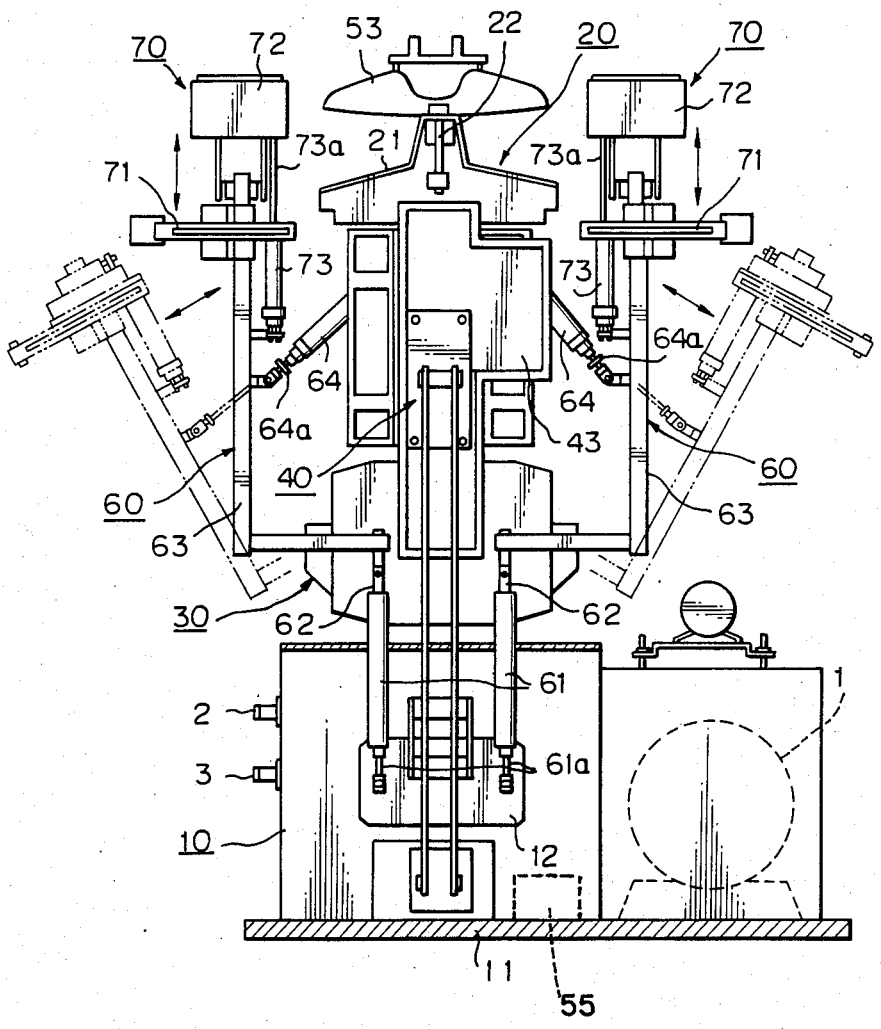
FIG. 1 is a partly omitted front view of an embodiment of the laundry presser in accordance with the present invention.
Figure 2:
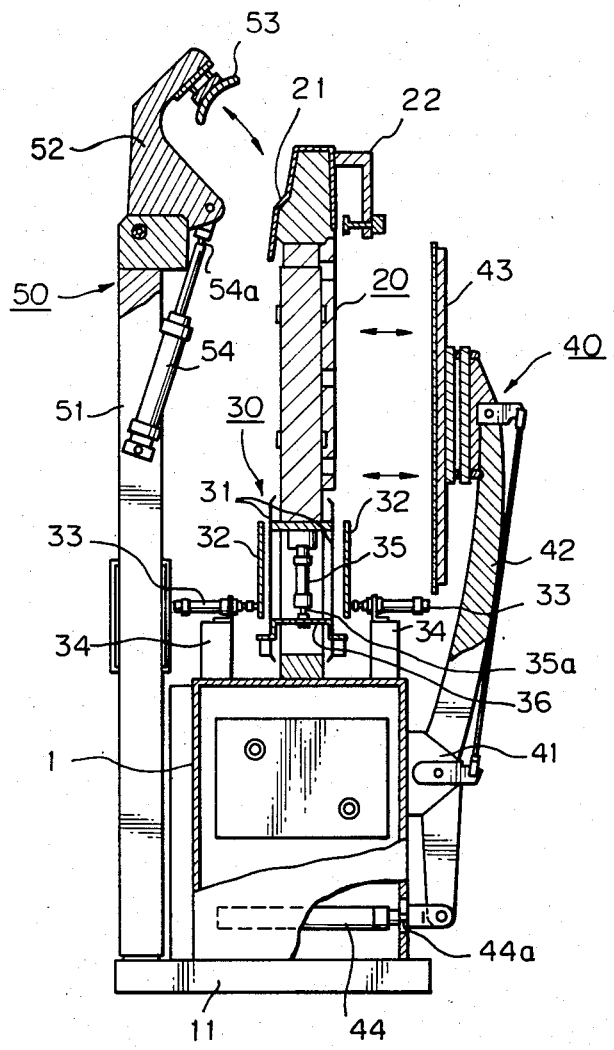
FIG. 2 is a partly omitted side view of the laundry presser shown in FIG. 1.

The laundry presser shown in FIGS. 1 and 2 includes, as major operational parts, a clothing bearer 20 adapted for bearing an article of clothing in position suited for total pressing, a skirt holder unit 30 adapted for holding an article of clothing stretched out, a body presser unit 40 adapted for pressing the body section of the clothing, a shoulder presser unit 50 adapted for pressing the shoulder section of the clothing and a pair of tack presser units 70 adapted for pressing the tack section of the clothing. Under programmed control by an automatic control unit 55 encased within a pedestal 10, these units are driven for concurrent operations.

The pedestal 10 is provided in the form of a hollow housing placed on a base plate 11 and is internally provided with a bracket 12 for a support unit 60. The pedestal 10 is further provided with a port for steam supply 2 and a port for steam exhaust 3. The port for steam supply 2 is connected, via a suitable piping, to a source of steam supply (not shown).

The clothing bearer 20 is mounted almost upright to the pedestal 10 and is patterned after a human body having shoulders 21. An article of clothing such as a shirt to be pressed is applied to the clothing bearer 10 and its collar is held firm by a collar holder 22 attached to the front top of the clothing bearer 20.

The skirt holder unit 30 is used for keeping the clothing on the clothing holder 20 stretched out during total pressing. The skirt holder unit 30 is attached partly to the clothing bearer 20 and partly to the pedestal 10. More specifically, the skirt holder unit 30 includes a pair of inner holders 31 spacedly sandwiching the lower section of the clothing bearer 20 on the front and rear sides. The inner holders 31 are connected at their lower ends to each other by a horizontal connector 36 which is secured to the piston rod 35*a* of a fluid cylinder 35 vertically coupled to the clothing bearer 20. The skirt holder unit 30 further includes a pair of outer holders 32 spacedly sandwiching the inner holders 31 on the front and rear sides. Each outer holder 32 is attached to the piston rod of a fluid cylinder 33 which is horizontally mounted to a stand 34 on the pedestal 10.

The body presser unit 40 includes a bracket 41 secured to the front face of the pedestal 10. A pair of almost vertical arms 42 are pivoted near their lower ends to the bracket 41. At the upper ends the arms 42 hold a heater plate 43 facing the front body section of the clothing bearer 20. The lower ends of the arms 42 are pivotally connected to the piston rod 44*a* of a fluid cylinder 44 horizontally encased within the pedestal 10.

The shoulder presser unit 50 includes a vertical post 51 arranged on the base plate 11 on the rear side of the clothing bearer 20. A substantially triangular holder 52 is pivoted at its apex to the top end of the post 51 and holds at its top end a heater plate 53 facing the shoulders 21 of the clothing bearer 20. Below the holder 52 is a fluid cylinder 54 which is secured to the post 51 with its piston rod 54*a* being pivoted to the lower corner of the holder 52.

The supporter unit 60 is arranged between the clothing bearer 20 and the body presser unit 40 and includes a pair of tiltable, vertical L-shaped arms 63 spaced from each other in the width direction of the laundry presser. Each arm 63 is coupled at its lower end to a rod 62 connected to the bottom of a vertical fluid cylinder 61 whose piston rod 61*a* is secured to the bracket 12 in the pedestal 10. A slant fluid cylinder 64 is secured at its bottom to the clothing bearer 20 and its piston rod 64*a* is pivoted to the body of each arm 63.

Each arm 63 holds a tack presser unit 70. More specifically, the tack presser units 70 each include a base plate 71 horizontally secured near the top end of the arm 63. The tack section of the clothing on the clothing bearer 20 is placed on the base plate 71. A heater plate 72 is pivoted to the top end of the arm 71 in an arrangement able to be brought into pressure contact with the base plate 71. To this end, a vertical fluid cylinder 73 is secured at its lower end to the body of the arm 63 and its piston cylinder 73*a* is pivoted to the heater plate 72 in an arrangement that extension and retraction of the piston rod 73*a* should cause turning of the heater plate about its pivot on the arm 63.

The laundry presser of the above-described construction operates as follows. In the initial state of the laundry presser, the piston rod of each of the fluid cylinders 33 is retracted so that the outer holder 32 should be located remote from the associated inner holder 31. The piston rod 35*a* of the fluid cylinder 35 is retracted so that the inner holders 31 should be located at the uppermost position. The piston rod 44*a* of the fluid cylinder 44 is retracted so that the heater plate 43 should be spaced from the front face of the clothing bearer 20. The piston rod 54*a* of the fluid cylinder 54 is extended so that the heater plate 53 should be spaced from the shoulder 21 of the clothing bearer 20. The piston rod 61*a* of each fluid cylinder 61 and the piston rod 64*a* of each fluid cylinder 64 are both retracted so that the associated arm 63 should assume the substantially vertical position shown with solid lines in FIG. 1. The piston rod 73*a* of each fluid cylinder 73 is extended so that the associated heater plate 72 should be located remote from the base plate 71. In this initial state of the laundry presser, an article of clothing, for example a shirt is applied to the clothing bearer and, if appropriate, buttoned up so that the shirt should wholly wrap the clothing bearer 20. The collar of the shirt is clamped to the front face of the clothing bearer 20 by the collar holder 22 and the skirt of the shirt is placed between the inner holders 31 and the outer holders 32. The tack sections of the shirt sleeves are placed on the base plate 71 of the tack presser unit 70.

When application of the shirt is completed, the fluid cylinders 33 are activated to extend the piston rods so that the skirt of the shirt should be clamped between the inner and outer holders 31 and 32. Thereupon the fluid cylinder 35 is activated to extend the piston rod 35*a* so that the body section of the shirt should be stretched vertically in tenstion. The blower 1 is then activated to blow hot air into the shirt for accelerated drying of the shirt.

Next, the fluid cylinders 73 are activated to retract the piston rods 73*a* so that the tack sections of the shirt should be press clamped between the heater plates 72 and the base plates 71, respectively. Thereupon, the fluid cylinders 61 are activated to extend the piston rods 61*a* and, concurrently, the fluid cylinders 64 are activated to extend the piston rods 64*a* so that the arms 63 should assume the slant position shown with chain lines in FIG. 1. As a consequence, the sleeves of the shirt are stretched in tension.

The fluid cylinder 44 is activated to extend the piston rod 44*a* so that the body front of the shirt should be press clamped between the clothing bearer 20 and the heater plate 43.

The fluid cylinder 54 is activated to retract the piston rod 54*a* so that the shoulder of the shirt should be press clamped between the clothing bearer 20 and the heater plate 53.

When all press clamping is over, steam is fed to the heater plates 43, 53 and 72 for heat pressing of the shirt on the clothing bearer 20. When heat pressing is over, the fluid cylinders 35, 44, 54, 61, 64 and 73 are all deactivated so that the laundry presser should resume the initial state for removal of the pressed shirt.

Phased operations of the various units are controlled as programmed by the control unit encased in the pedestal. Though not shown in the drawings, the laundry presser is further provided with a console for control by the operator. As an alternative for the fluid cylinders used for the foregoing embodiment, suitable solenoids, cam-link mechanisms, reversible motor-gear combinations may be used.

In accordance with the present invention, pressing of various sections of a clothing can be carried out almost concurrently on a single laundry presser by a single operator. Thus, use of the laundry presser in accordance with the present invention is quite time, space and labor saving.

I claim:

1. An improved laundry presser comprising a pedestal, a clothing bearer arranged vertically on said pedestal and substantially patterned after a human upper body, a skirt holder unit arranged on said pedestal and including two pairs of inner and outer holders which face the lower end of said clothing bearer, a body presser unit mounted to said pedestal and including a first heater plate which faces the body front of said clothing bearer, a shoulder presser unit arranged on said pedestal and including a second heater plate which faces the shoulder of said clothing bearer, a supporter unit mounted to said pedestal and including a pair of base plates located on both lateral sides of the shoulder of said clothing bearer, a pair of tack presser units held atop by said supporter unit and each including one of a pair of third heater plates which face said base plates of said supporter unit, respectively, means for supplying steam to said first to third heater plates, and a control unit for controlling operations of said units and said supplying means so that said body, shoulder and tack presser units can be driven for substantially concurrent pressing of an article of clothing applied to said clothing bearer.

2. An improved laundry presser as claimed in claim 1, for pressing an article of clothing having a skirt portion, said presser further comprising means for blowing hot air into said article of clothing applied to said clothing bearer after the skirt portion of said article of clothing is caught by said skirt holder unit.

3. An improved laundry presser as claimed in claim 1 or 2 in which said skirt holder unit further includes means for driving each said outer holder into pressure contact with said inner holder associated therewith, and means for driving said inner holders into vertical movement.

4. An improved laundry presser as claimed in claim 1 or 2, for pressing an article of clothing having a front body section, in which said body presser unit further includes means for driving said first heater plate into pressure contact with the front body section of said article of clothing applied to said clothing bearer.

5. An improved laundry presser as claimed in claim 1 or 2, for pressing an article of clothing having a shoulder section, in which said shoulder presser unit further includes means for driving said second heater plate into pressure contact with the shoulder section of said article of clothing applied to said clothing bearer.

6. An improved laundry presser as claimed in claim 1 or 2, for pressing an article of clothing having tack sections, in which said tack presser unit further includes means for driving said third heater plates into pressure contact with the tack sections of said article of clothing applied to said clothing bearer, said tack sections being placed on said base plates of said supporter unit.

7. An improved laundry presser as claimed in claim 1 or 2 in which said supporter unit includes a pair of normally upright arms, each carrying atop one of said base plates of said supporter unit, and means for swinging said arms laterally outwards apart from each other.

* * * * *